United States Patent [19]

Vesper

[11] 4,307,656

[45] * Dec. 29, 1981

[54] ROOM HUMIDIFIER

[76] Inventor: James E. Vesper, 2408 Stratton Dr., Potomac, Md. 20854

[ * ] Notice: The portion of the term of this patent subsequent to Oct. 7, 1997, has been disclaimed.

[21] Appl. No.: 189,394

[22] Filed: Sep. 19, 1980

[51] Int. Cl.[3] ..... F23L 13/00

[52] U.S. Cl. ..... 98/109; 98/30; 98/100; 98/105

[58] Field of Search ..... 98/30, 100, 105, 109, 98/103, 108

[56] References Cited

U.S. PATENT DOCUMENTS

| | | | |
|---|---|---|---|
| 1,383,477 | 7/1921 | Menk | 98/108 |
| 1,624,226 | 4/1927 | Elters | 98/103 |
| 1,645,140 | 10/1927 | Herbruck | 98/108 |
| 2,161,001 | 6/1939 | Bedol | 98/105 |
| 3,052,416 | 9/1962 | Stephen | 261/104 |
| 3,115,447 | 12/1963 | Stengel | 29/455 |
| 3,136,017 | 6/1964 | Reziosi | 24/221 K |
| 3,159,393 | 12/1964 | Villano | 24/221 K |
| 3,169,293 | 2/1965 | Neuschotz | 24/221 K |
| 3,225,679 | 12/1965 | Meyer | 98/103 |
| 3,227,064 | 1/1966 | Spangle | 98/109 |
| 3,276,754 | 10/1966 | Skerritt | 261/104 |
| 3,673,770 | 7/1972 | Novak | 98/105 |
| 3,891,253 | 6/1975 | Revell | 292/59 |
| 3,920,144 | 11/1975 | Callen | 220/22 |
| 3,923,156 | 12/1975 | Wallestad | 206/564 |
| 4,023,691 | 5/1977 | Perel | 206/564 |
| 4,226,174 | 10/1980 | Vesper | 98/30 |

*Primary Examiner*—Henry C. Yuen

*Attorney, Agent, or Firm*—Sughrue, Mion, Zinn, Macpeak & Seas

[57] ABSTRACT

The room humidifier is convertible for use with either a wall register, baseboard heating unit, console type heating unit or steam radiator and includes a container portion adapted to hold a supply of water and an air deflector portion detachably connected to the rear of the container. The container is of substantially rectilinear construction with aligned front and rear openings spaced from the bottom of the container through which the air is adapted to pass. Water absorbent plates are disposed in the water container and extend into the space between the front and rear openings so that the air will pass over the plates. A latch device is provided for securing the container portion without the air deflector to a wall register or baseboard heating unit.

2 Claims, 5 Drawing Figures

10
14
12
22
58
22
28
16
18

34
42
46
14
36
38
40
32
44
68
22
28
30
24
54
26
68
20

ROOM HUMIDIFIER

BACKGROUND OF THE INVENTION

1. Field of the Invention

The present invention is directed to a room humidifier and more specifically to a room humidifier of the type adapted to be detachably supported from a standard wall register or placed on a floor register or upright console unit.

2. Prior Art

The broad idea of detachably supporting humidifiers from a hot air wall register is old and well known in the art. The simplest of these involve a simple open container of water which is detachably secured to the wall register by any suitable means so that the passage of hot air over the surface of the water will pick up some of the evaporated moisture. Other prior art devices went a step further and supported a fabric by some suitable means in the hot air path parallel to the face of the register with the lower end of the fabric disposed in the container of water. Such an arrangement however was generally unattractive and substantially impaired the flow of hot air from the register thereby decreasing the over-all efficiency of the heating system. Still other prior art devices utilize free standing artificial plants having wick-type means associated therewith which were placed in the container of water so that the humidifier resembled an artificial planter. However, the efficiency of such artificial flowers for assisting the transfer of moisture left much to be desired in the way of efficiency.

As opposed to the relatively open water containing type humidifiers, other prior art devices provided a substantially closed container which was adapted to fit over and completely cover the wall register. Although the rear surface of such containers was substantially open, the front surface consisted substantially of a plurality of closely spaced apart louvres which seriously impeded the flow of air through the humidifier. A plurality of sponge-like blocks were provided within the interior of the container to provide a capillary action for drawing water from a trough in the bottom of the container. However, the use of such sponge blocks further impeded the flow of air thereby greatly reducing the over-all efficiency of the heating system. An example of such a room humidifier is U.S. Pat. No. 3,227,064, granted to William S. Spangler on Jan. 4, 1966.

With respect to floor registers, various attempts have been made to provide humidifiers which would either be placed in the heating duct immediately below the floor register or which would rest on the upper surface of the floor register to allow the hot air to pass upwardly through the humidifier over a body of water contained within the humidifier. Such arrangements were generally complicated and inefficient and suffered from the same drawbacks as prior art wall registers.

In applicant's copending patent application Ser. No. 739,882, filed Nov. 8, 1976, now U.S. Pat. No. 4,226,174, a novel, efficient room humidifier was disclosed which was adapted to be mounted on a wall register. This room humidifier provided for improved flow of air over a plurality of water absorbing plates, a unique mounting system for said plates, and a water level indicator. The room humidifier is energy efficient since it does not require any source of power for the operation thereof.

SUMMARY OF THE INVENTION

The present invention provides a new and improved room humidifier which may be selectively mounted on a floor register, a wall register, or a console type heating unit having air discharge openings in the upper surface thereof.

The present invention provides a new and improved room humidifier similar to that disclosed in applicant's copending application Ser. No. 739,882, filed Nov. 8, 1976, now U.S. Pat. No. 4,226,174, but further including a new and improved housing design for controlling the air flow, a new and improved fastening means for securing the room humidifier to a wall register and a new adapter unit which may be attached thereto to render the room humidifier suitable for use on a floor register or console type heating unit. The adapter unit is so designed as to be removable from the room humidifier when it is desired to mount the room humidifier on a wall register and is so shaped and designed as to fit completely within the room humidifier during shipment or storage to conserve space.

The present invention provides a new and improved room humidifier of the type adapted to be detachably mounted on a wall register comprising a substantially rectilinear container defining a water reservoir in the base thereof and having substantially rectilinear aligned apertures in the front and rear major surfaces above the reservoir. The apertures are substantially coextensive with the dimensions of a conventional wall register to facilitate the flow of the entire hot air supply through the humidifier. The container may be constructed of one-piece molded plastic material having integral parallel grooves on the interior surface of the top, bottom and front walls for guiding and supporting a plurality of absorbent plates in parallel spaced apart relation to each other perpendicular to said apertures. A float is provided having a vertically disposed extension which can be visible through the front aperture or extend through the top wall of the container for indicating the water level in the reservoir. An attachment member is provided which extends through the front and rear walls of the container immediately below said apertures and is comprised of two telescopically threaded members, one of which has manually operable turning means secured to one end thereof which extends outwardly through the front wall of the container and the other of which is provided with a hook member adapted to engage the louvers of a wall register. The aperture in the front wall is provided with a downwardly curved air deflector along the upper edge thereof to deflect the flow of air emerging from the opening in a generally downward direction. An air deflector adapter is provided with the curved rear wall adapted to extend downwardly from under the top rear edge of the container to a point spaced substantially rearwardly of the container and a pair of integral side walls having hook means thereon adapted to engage the lower edge of the aperture in the rear wall of the container so that air rising upwardly from a floor register or the top air vent of a console heating unit will be deflected forwardly through the room humidifier over the absorbent plates.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
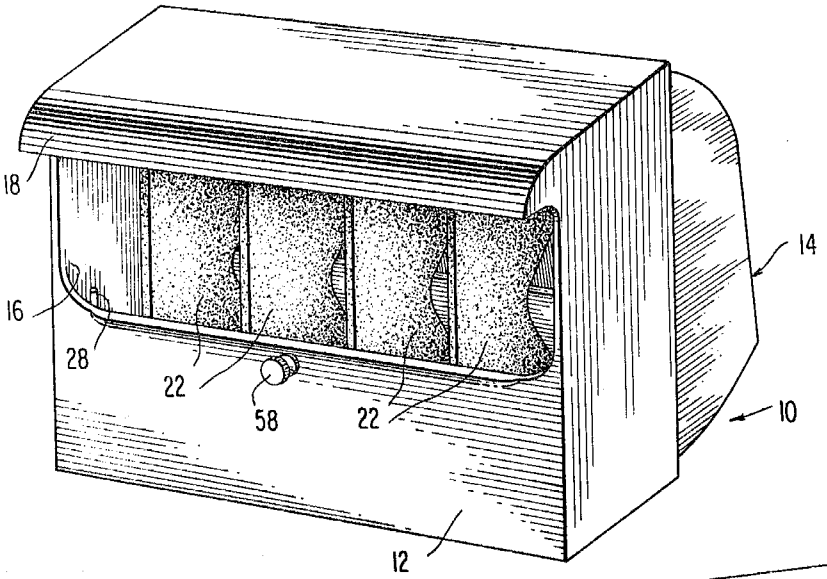
FIG. 1 is a perspective view of the room humidifier according to the present invention with the air deflector adapter attached thereto.
Figure 2:
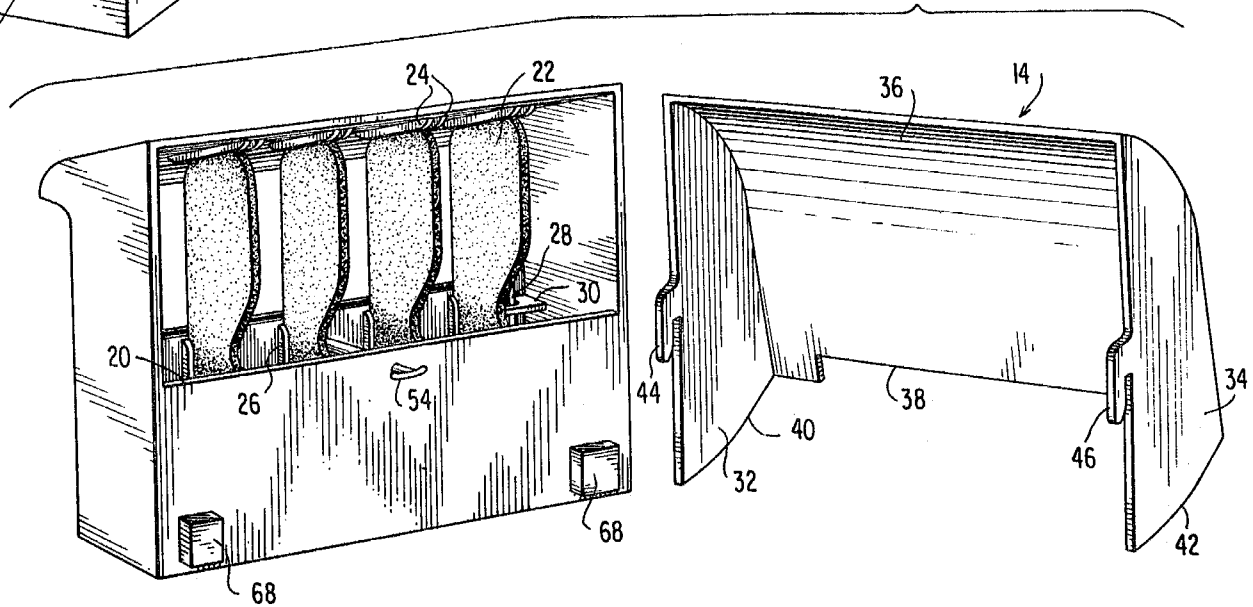
FIG. 2 is an exploded view of the room humidifier and air deflector adapter showing the insides of both parts.

The room humidifier 10 according to the present invention is comprised of a substantially rectilinear container 12 having moisture dispensing means therein and a detachable air deflector 14. The container 12 is constructed substantially identically with the container disclosed in applicant's copending application Ser. No. 739,882, filed Nov. 8, 1976, now U.S. Pat. No. 4,226,174. However, a forwardly and downwardly extending projection 18 is provided across the top front edge of the container above the front aperture 16 in order to deflect the air passing through the humidifier downwardly as it passes outwardly through the front opening 16.

As in the prior construction, a plurality of absorbent plates 22 are mounted in vertical parallel spaced relation to each other within the container in slots defined by ribs 24 and 26. A water level indicator is located in a forward corner of the container and is comprised of a float member 28 guided for vertical movement by brackets 30 so as to be readily visible through the front aperture 16.

Figure 5:
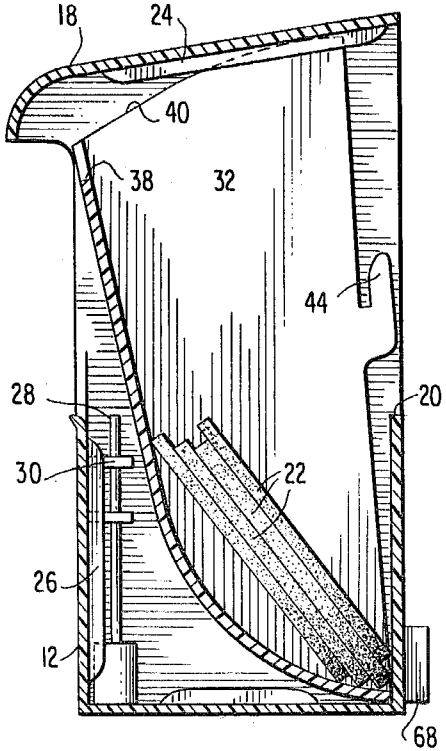
FIG. 5 is a transverse sectional view of the room humidifier according to the present invention with the air deflector adapter and absorbent plates disposed within the room humidifier in the shipment or storage mode.

The air deflector 14 is comprised of two side walls 32 and 34 and a curved rear wall 36. The bottom edge of the rear wall 36 is provided with a rectangular recess 38 and the bottom edges 40 and 42 of the side walls 32 and 34 respectively are curved upwardly and rearwardly to facilitate the storage of the air deflector 14 within the humidifier container 12 during shipment or storage as illustrated in FIG. 5. The recess 38 provides clearance for the ribs 24 on the underside of the top wall of the container and the curved edges 40 and 42 on the side walls also allow the air deflector unit to be inserted upside down and clear the top wall of the container 12 when the deflector unit is fully inserted into the container 12.

Figure 3:
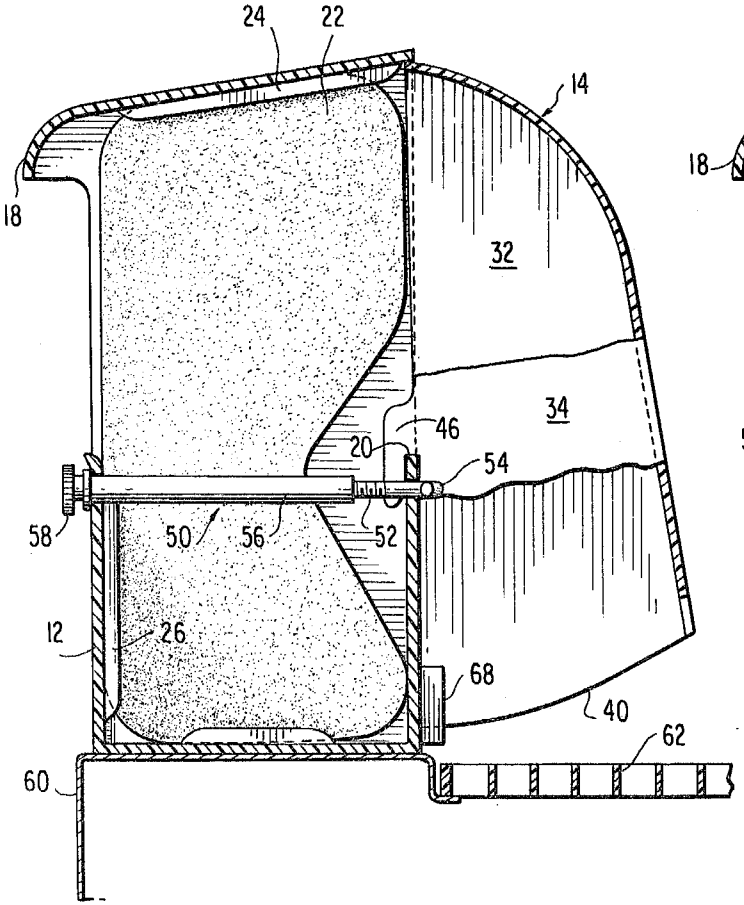
FIG. 3 is a transverse sectional view of the room humidifier with the air deflector unit attached thereto in operative position relative to an upwardly directed air register or vent.

The deflector 12 is provided with a pair of forwardly and downwardly projecting hook portions 44 and 46 on the forward edges of the side walls 32 and 34 respectively. The hook portions 44 and 46 are adapted to hook over the upper edge 20 of the rear aperture of the container 12 as illustrated in FIG. 3. With the deflector 14 secured in this manner to the rear of the humidifier container 12 the top edge of the rear wall 36 will fit snugly beneath the upper rear edge of the top wall of the container and the lower forward edges of the side walls 32 and 34 will be disposed in engagement with the rear wall of the container 12. Thus, when the humidifier 10 is placed on a console unit 60 as illustrated in FIG. 3, the deflector unit 14 will extend over the air vent 62 so that air emanating upwardly through the air vent 62 will pass into the deflector 14 and be deflected forwardly through the rear and front apertures of the container 12 past the humidifier plates 22. The same configuration of the humidifier 10 would be utilized with a floor register and the humidifier 10 would be placed on the floor with the deflector 14 disposed over the register in the same manner as illustrated in FIG. 3 with respect to a console unit.

Figure 4:
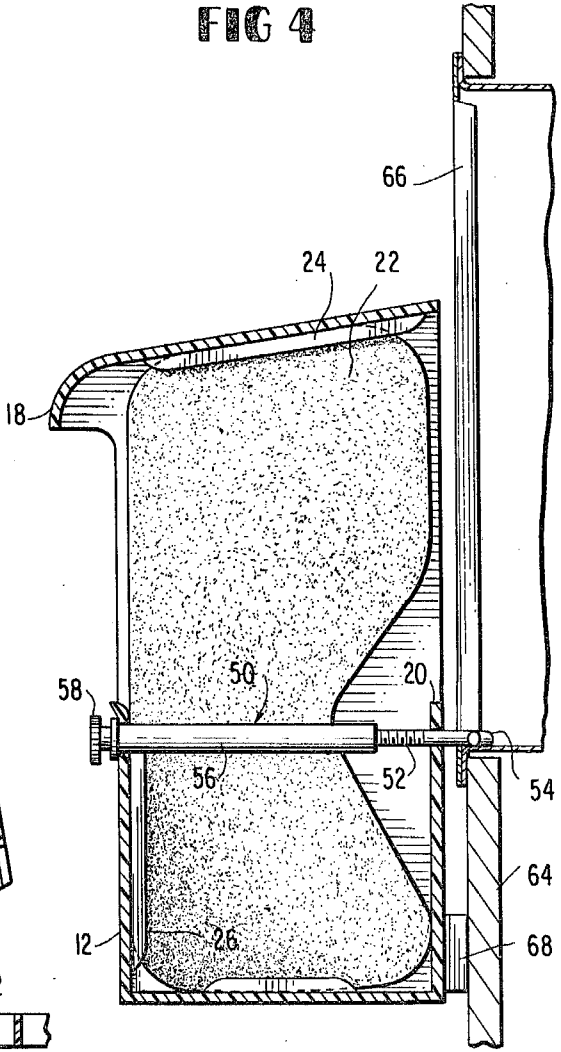
FIG. 4 is a transverse sectional view of the room humidifier according to the present invention with the air deflector adapter removed and the room humidifier secured to a vertically disposed wall register.

When it is desired to use the humidifier in conjunction with a wall register, a new and improved supporting arrangement has been provided for the container 12 as best illustrated in FIG. 4. The mounting means 50 is comprised of an externally threaded rod 52 having an arcuate double hook portion 54 on one end thereof adapted to extend between and grip the louvers 66 of a vertically disposed wall register. The rod 52 is threaded into a tubular sleeve 56 which extends through the front wall of the container 12 and is provided with a knurled knob 58. In order to mount the container 12 on the louvers 66 of the vertically extending wall register, it is only necessary to rotate the rod 52 relative to the sleeve 56 sufficiently to extend the hook portion a substantial distance beyond the rear wall of the housing. With the container 12 positioned in front of a wall register the knob 58 can be turned to dispose the hook portions 54 in a vertical plane so that they may pass between two adjacent louvers 66. The knob 58 can then be turned so as to dispose the hook portions 54 in a horizontal plane whereby each hook portion will pass behind a louver 66 in gripping relation relative thereto. The knob 58 is then rotated to screw the rod 52 into the sleeve 56 while pulling on the knob 58 to maintain the hook portions 54 in engagement with the louvers during the threading operation. Spacer blocks 68 are secured to the rear wall of the container 12 to assist in maintaining the container substantially vertical.

Both the container 12 and the deflector 14 may each be molded in one piece or may be comprised of several pieces secured together by any suitable adhesive. While the container 12 and deflector 14 are preferably made of plastic material, it is conceivable that other materials may be used.

The console type unit as shown in FIG. 3 is the type of heating and airconditioning unit commonly found in modern office buildings and apartment houses wherein the unit is placed directly under the window. It is also contemplated that the console type heating unit could also be a cabinet type enclosure designed to enclose a conventional steam radiator with the heated air adapted to rise upwardly through the grille 62. The room humidifier as shown in FIG. 3 could also be placed directly on top of a conventional steam radiator with the air deflector portion extending over the space between the radiator and the wall against which the radiator is placed. When the air deflector is removed the room humidifier may also be secured to the louvers of a wall type register immediately adjacent the floor or to a standard baseboard heating unit of either the hot water type or electric type.

While the invention has been particularly shown and described with reference to preferred embodiments thereof, it will be understood by those in the art that various changes in form and details may be made therein without departing from the spirit and scope of the invention.

What is claimed is:

1. A room humidifier comprising substantially rectilinear container means having top, bottom, side, front and rear walls, said front and rear walls each having a single substantially rectilinear aperture, said apertures being aligned with each other and substantially coextensive with the upper half of said front and rear walls with the lower half of said front and rear walls in conjunction with said side walls and bottom walls defining a water reservoir, a plurality of evaporation plates, means for supporting said evaporation plates in vertical, parallel, spaced apart relation relative to each other within said container means, air deflector means having attachment means for detachably connecting said air deflector means to the rear wall of said container means for deflecting a vertically upward flow of air horizontally through said apertures in said container means and connecting means for detachably connecting said container means to a vertically disposed wall register in the absence of said air deflector means, said connecting means being comprised of a tubular sleeve having internal threads and grasping means on one end thereof and an externally threaded bolt having hook means on one end thereof, said sleeve being rotatably supported in said front wall of said container means with said grasping means located externally of said container means immediately below said aperture in said front wall and said bolt being rotatably supported in said rear wall with said hook means being located outside said container means immediately below said aperture in said rear wall so that upon threading said bolt into said sleeve with said hook means engaging said wall register, said container means will be drawn against said wall register.

2. A room humidifier comprising substantially rectilinear container means having top, bottom, side, front and rear walls, said front and rear walls each having a single substantially rectilinear aperture, said apertures being aligned with each other and substantially coextensive with the upper half of said front and rear walls with the lower half of said front and rear walls in conjunction with said side walls and bottom wall defining a water reservoir, a plurality of evaporation plates, means for supporting said evaporation plates in vertical, parallel, spaced apart relation relative to each other within said container means and air deflector means having attachment means for detachably connecting said air deflector means to the rear wall of said container means for deflecting a vertically upward flow of air horizontally through said apertures in said container means, said air deflector means being comprised of two parallel side walls spaced apart a distance substantially equal to the distance between said side walls of said container means, a curved wall integral with said side walls and extending from the forward uppermost corner of said side walls to the rearward lowermost corner of said side walls and said attaching means being comprised of hook means integral with and extending forwardly of said side walls for engagement with said rear wall of said container through the aperture therein.

* * * * *